United States Patent [19]

Townsend

[11] Patent Number: 4,860,805

[45] Date of Patent: Aug. 29, 1989

[54] FILTERED WATERBED FILLING SYSTEM

[76] Inventor: Arthur M. Townsend, 505 N. Lake Shore Dr. Apt. 3911, Chicago, Ill. 60611

[21] Appl. No.: 216,124

[22] Filed: Jul. 7, 1988

Related U.S. Application Data

[63] Continuation-in-part of Ser. No. 121,661, Nov. 11, 1987, abandoned.

[51] Int. Cl.[4] ..... B65B 3/04; A47C 17/86

[52] U.S. Cl. ..... 141/382; 141/98; 141/384; 141/313; 141/286; 5/451; 5/455; 210/485

[58] Field of Search ..... 141/98, 392, 1, 286, 141/313, 114, 382–386; 210/485, 484; 5/451, 455, 508; 4/192, 623; 138/41; 137/550, 544

[56] References Cited

U.S. PATENT DOCUMENTS

| | | | |
|---|---|---|---|
| 659,365 | 10/1900 | Waldo | 137/550 |
| 938,947 | 11/1909 | Andres et al. | 137/550 |
| 982,434 | 1/1911 | Koss | 137/550 |
| 1,959,314 | 5/1934 | Wile | 210/164 |
| 3,797,538 | 3/1974 | Mollura | 141/313 |
| 3,920,043 | 11/1975 | Fowell | 137/625 |
| 4,212,335 | 7/1980 | Bova | 141/382 |
| 4,316,489 | 2/1982 | Price | 141/1 |
| 4,332,044 | 6/1982 | Houk, Jr. | 5/453 |
| 4,386,638 | 6/1983 | Hall et al. | 141/98 |
| 4,673,010 | 6/1987 | Prufer et al. | 141/382 |

OTHER PUBLICATIONS

The Filtertek Companies Brochure entitled "Molded Filters for Precise Particle Control", 1981.

Gelman Sciences Brochure entitled "Microseparation for the Designer with Unlimited Imagination . . . " (undated).

*Primary Examiner*—Ernest G. Cusick

*Attorney, Agent, or Firm*—Hill, Van Santen, Steadman & Simpson

[57] ABSTRACT

A filtered waterbed filling system is provided which prevents or substantially reduces bacteria and algae growth in stagnant, heated water contained in a waterbed. The filling system may be a one-piece filling probe, or a universal hose coupling assembly may be provided which is mateable with either a separate filtered filling probe for filling the waterbed, or a separate drain probe for emptying water from the waterbed. The filtered filling probe employs a filter material formed in a cylinder shape and which extends a length of the probe and which is embedded in an outer supporting matrix. A pore size of the filter material prevents passage of at least some bacteria or other contaminants so as to aid in the prevention of bacteria and algae growth within the water mattress and/or to aid in reducing deterioration of the water mattress and/or inserts associated with the mattress. With the system disclosed, the use of a chemical solution to control bacteria growth is substantially reduced or eliminated.

30 Claims, 3 Drawing Sheets

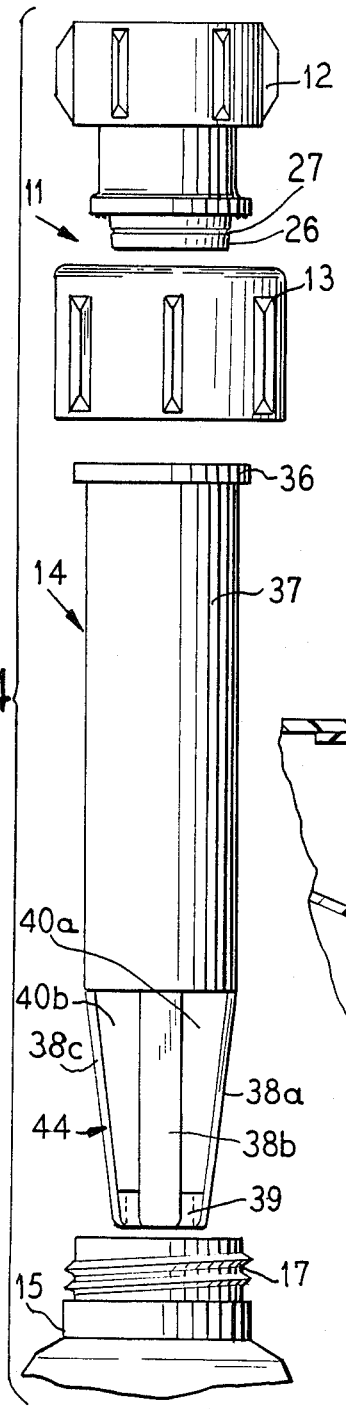
FIG. 4
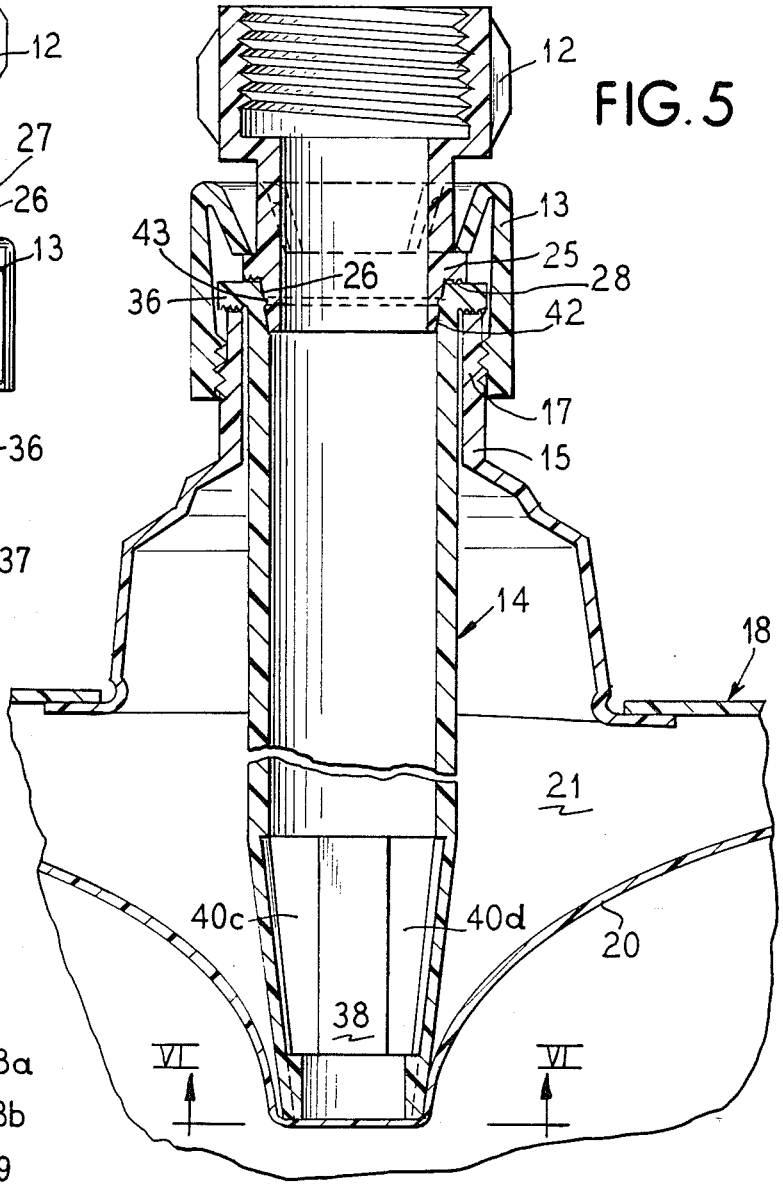
FIG. 5
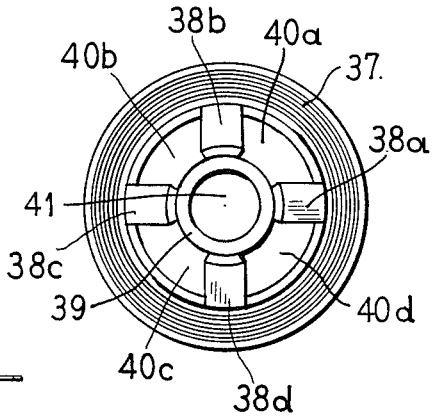
FIG. 6
FIG. 8
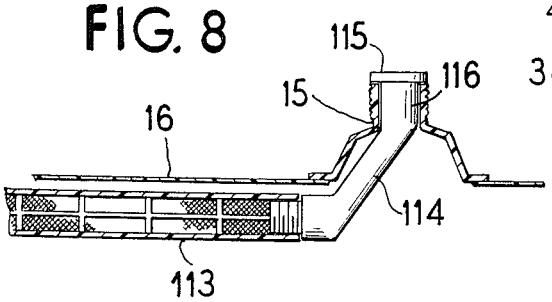

FILTERED WATERBED FILLING SYSTEM

RELATED APPLICATION

This is a continuation-in-part of my earlier filed U.S. application Ser. No. 121,661, filed November 11, 1987 now abandoned, for "FILTERED WATERBED FILLING SYSTEM".

BACKGROUND OF THE INVENTION

1. Field of the Invention

The invention relates to the problem of bacteria and algae growth in waterbeds.

2. Description of the Prior Art

Bacteria and algae grow in the stagnant, heated water contained in a waterbed or mattress. Currently the only known cure for this problem is the periodic addition to that water of a chemical solution commonly referred to as "waterbed conditioner". Although the addition of this chemical handles the problem in most cases, it creates other problems.

One problem is that some people, mainly small children, will drink some of the water from the bed or drink some of the chemical from its bottle. While most of the waterbed chemicals on the market cause no permanent harmful effects, some do. These chemicals are used to kill particularly harmful types of bacteria that form in certain types of water mattresses, namely, "motionless" or "waveless" water mattresses.

Another problem is that when the water mattress is emptied for moving or storage, all the water from that mattress, including the chemical, goes down the drain and back into the water supply, adding to the ever growing pollution problem.

A few years ago the water mattress manufacturers introduced a "motionless" or "waveless" water mattress. They achieved this by placing "floating baffles" consisting of foam rubber and vinyl in a miriad of combinations, or by placing a chunk of porous dried spaghetti-like fiber in the mattress. This fiber or these baffles greatly reduce the wave motion caused by getting into or out of the waterbed or by tossing and turning.

While these new "waveless" mattresses dramatically increased the sale of waterbeds, it created a considerable problem, primarily, the opportunity for certain types of bacteria to attach themselves to the foam or fiber floating in the mattress, allowing this bacteria to grow colonies. The by-product of one type of this bacteria, known as "sulphur bascilus", is a sulphur gas that permeates through the vinyl mattress and creates a foul odor in the bedroom and in many cases the entire house.

Harsh chemical solutions are currently the only treatments available to cure the problem. The more toxic the chemical the better the cure. The better the cure the greater the oppportunity for personal harm and for pollution of our water supply.

Typically, waterbeds are filled by connecting one end of a hose to a nearby faucet and the other end to a male coupling on a valve connected to convey water into the waterbed or mattress after removal of a closure member such as a cap from the valve. Typically, a coupling is employed to connect the male threaded hose end to the male coupling element. For draining, an integral projection is provided on the valve which has draingage apertures therein for draining the water from the waterbed and for maintaining a spacing of the inner lining or floating baffle away from the valve during the draining operation.

With such a filling and draining system, the aforementioned bacteria and algae growth can occur.

Additionally, it has been found that other water impurities, such as minerals, cholorides, and sulfates, help to cause deterioration of the water bed mattress and inserts.

SUMMARY OF THE INVENTION

It is an object of the invention to very substantially reduce or eliminate the chemical needed for treating the water to prevent or reduce bacteria and/or algae growth in a waterbed mattress.

It is a further object to reduce or eliminate other impurities from the water used to fill the waterbed so as to reduce deterioration of the waterbed.

According to the invention, the bacteria and/or algae and/or other impurities are reduced or substantially prevented from ever entering the waterbed, thus eliminating or greatly reducing the need for harsh chemicals now being used to combat such bacteria or algae growth, and to reduce deterioration of the waterbed. In addition, since no chemicals are added to the water, the water may be reused after a re-filtering and boiling.

With the invention, a first means is provided for coupling a source of water to the waterbed filling valve. A second means associated with the first means filters the water as it flows into the waterbed so as to prevent passage of at least some bacteria or othr matter which causes bacteria or algae growth in the water within the waterbed.

More particularly, a filtered filling probe is employed having hose coupling means associated therewith for coupling to a hose, and being dimensioned to be insertable into the valve of the waterbed. The filtered filling probe has a surface formed of a filter means to aid in preventing passage of bacteria or other matter which causes bacteria or algae growth in the water within the waterbed, or deterioration thereof.

In a particularly useful embodiment of the invention, a universal hose coupling assembly is provided which mates with either a separate filtered filling probe or a separate drain probe. The filtered filling probe employs a filter having a pore size which traps algae and bacteria, and particularly sulphur bascilus bacteria. A coarse pre-filter is also provided for preventing larger objects such as small stones or the like from puncturing the filter and entering the waterbed. During draining of the waterbed, the separate filtered filling probe is replaced by a separate drain probe which mates with the same common hose coupling assembly.

BRIEF DESCRIPTION OF THE DRAWINGS

FIG. 4 is a side view of the waterbed filling and draining system with the drain probe positioned for coupling with the hose coupling assembly;

FIG. 5 is a cross-sectional view of the coupling assembly joined to the drain probe with the drain probe seated in the filling and draining valve of the waterbed for draining water from the bed;

FIG. 6 is an end view along line VI—VI of FIG. 5 showing the insertion end of the drain probe;

FIG. 8 is an alternate embodiment of the filtered filling probe wherein a filter portion of the probe extends horizontally.

DESCRIPTION OF THE PREFERRED EMBODIMENTS

Figure 1:
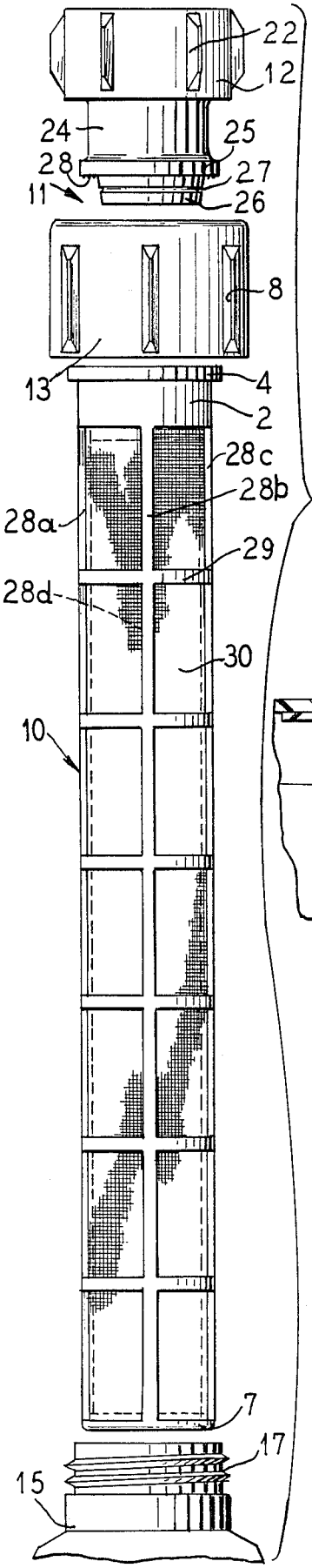
FIG. 1 is a side view of the filtered waterbed filling and draining system with the filtered filling probe in position.
Figure 2:
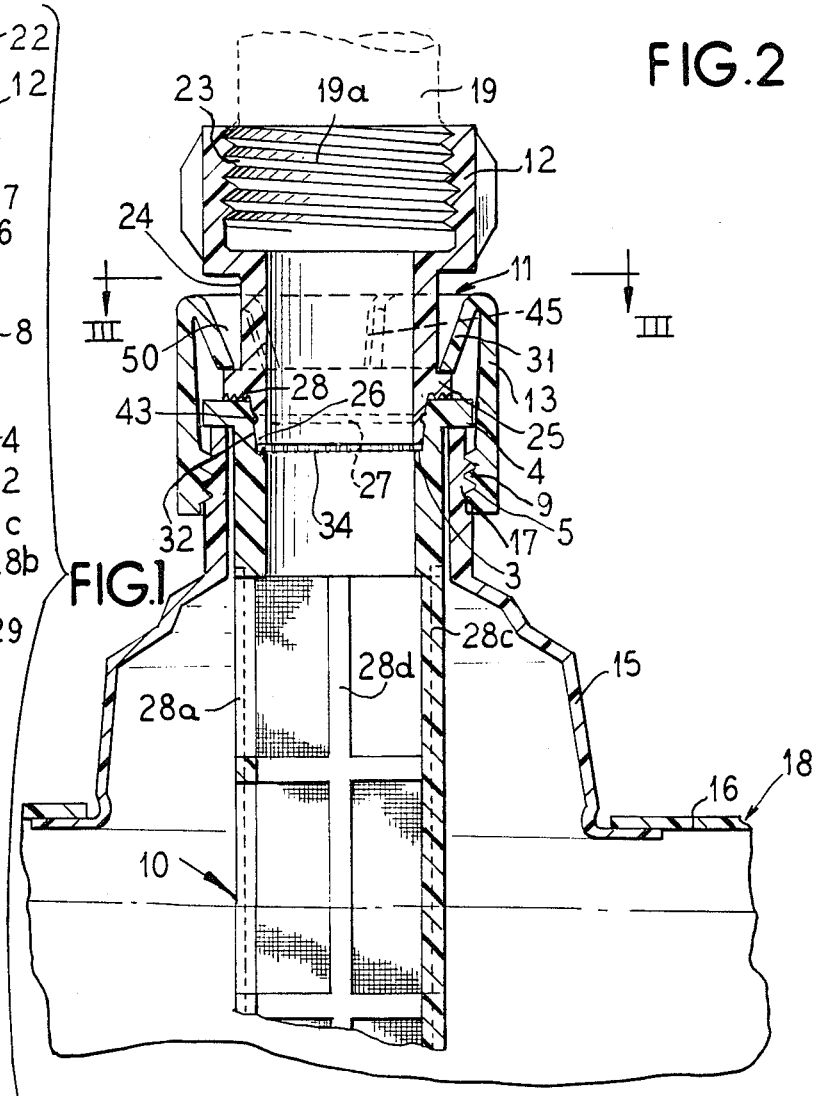
FIG. 2 is a fragmentary cross-sectional view of the hose coupling assembly and the filtered filling probe of FIG. 1 mated to one another and engaged in a filling and draining valve for the waterbed.
Figure 3:
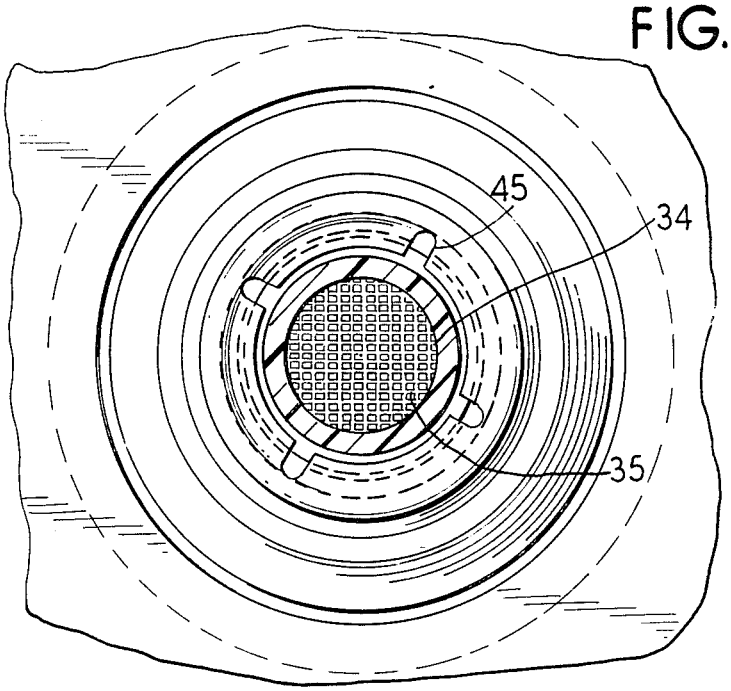
FIG. 3 is a top view taken along line III—III of FIG. 2 showing a pre-filter inserted at a leading end of the filtered filling probe.

With the filtered waterbed filling and draining system of the invention shown in FIGS. 1 through 6, a universal hose coupling assembly 11 is employed either with a finger-like substantially cylindrical filtered filling probe 10 (as shown in FIGS. 1, 2, and 3), or with a finger-like substantially cylindrical drain probe 14 (as shown in FIGS. 4, 5, and 6), either of which are inserted in a filling and draining valve after removal of a closure member such as a cap (not shown).

It is to be understood that in referring to substantially cylindrical probes 10 and/or 14, that such probes may, within the scope of this invention, have a circular, square, or other similiar cross section, and the term cylindrical as used in this specification is intended to broadly include such other shapes. Referring now to FIGS. 1, 2, and 3, for filling the waterbed 18, a hose 19 is connected at one end (not shown) to a water source and at its opposite end to the universal hose coupling assembly 11. The hose coupling assembly 11 includes a female hose connector 12 having outer knurls 22 and an inner thread 23. The hose connector 12 also has an intermediate narrow diameter throat 24 which terminates in a larger diameter sealing lip 25 having two concentric circular sealing rings or projections 28 on a lower side thereof. Below the lip 25 a tapered insert portion 26 is provided together with a female or concave circular ring 27 which mates with a corresponding male snap ring 43 on a bevel 32 at an upper end of the filtered filling probe 10 in order to provide a snap connection. In an alternate embodiment, male and female threads may be employed in lieu of ring 27 and ring 43.

A female coupling element 13 may be pushed over the sealing lip 25 into place surrounding the intermediate narrow diameter throat 24. For this purpose, the coupling element 13 has an inner conical retainer collar 50 which is made flexible by slots 45. Accordingly, the coupling 13 may be slip fit over the sealing lip 25 into place so that it is then freely rotatable.

The female coupling element 13 has on its inside wall at one end thereof threads 9 which engage with threads 5 at male coupling 17 on the fitting and draining valve 15 connected to the waterbed outer wall 16.

As can be seen in FIG. 2, the concentric circular projections 28 seal with a top surface of the sealing lip 4 on the filtered filling probe 10.

The coupling element 13 may also have knurls such as shown at 8 for gripping.

The filtered filling probe 10 comprises a molded plastic body extending downwardly from the sealing lip 4 through a molded plastic body upper portion 2 into four joined vertical ribs 28*a, b, c, d* and intersecting circular horizontal ribs 29 so as to form a long cylindrical matrix or grid structure. A filter material 30 is embedded in the four vertical ribs 28*a, b, c, d* and circular horizontal ribs 29 during the molded operation throughout the length of the filling probe 10.

The leading or insertion end of the filling probe 10 is in the shape of a solid disc 7 also made of the same plastic as the ribs 28*a*, 28*b*, 28*c*, 28*d*, horizontal ribs 29, upper portion 2, and sealing lip 4.

The molded plastic employed for the filtered filling probe is preferably injection molded with the filter material in place so that the filter material is embedded the four vertical ribs 28*a*, 28*b*, 28*c*, 28*d* and horizontal circular ribs 29.

It is believed some sulphur bascilus bacteria have an outer dimension of approximately 0.6 microns. Ideally for such bascilus a 0.45 micron filter has been found to effectively block passage of such bacteria. The filter material is preferably a white acrylic copolymer coating over a non-woven nylon fabric having pore openings set to pass particles smaller than 0.45 microns and which will block the passage of particles, algae, or bacteria having a larger dimension. In one embodiment, a Versapor (Versapor is a registered trademark of Gelman Sciences, 600 South Wagner Road, Ann Arbor, Michigan 48106) hydrophilic material V-450 has been employed which is a 0.45 micron filter. It is possible to employ smaller pore sizes for the filter material as small as 0.2 micron filter material. It is also possible to employ larger openings depending upon the filter characteristics desired such as up to 1 micron as long as desired bacteria and/or algae filtering characteristics are achieved.

Since it has been found that shortly after use, the filter material pore size openings decrease in size with use (such as by clogging or similar effects), it is preferred to employ a filter material having a pore size which is sufficiently large such that when the normally occurring reduction in size of the pores occurs during use, substantial water flow can still be achieved, while still preventing passage of at least some and preferrably substantial amounts of bacteria or other matter to aid in the prevention of bacteria, algae growth, or other impurities in the water within the waterbed. For example, an initial pore size of 3 microns may be employed, which pore size becomes small with use so as to prevent the passage of at least some bacteria and/or algae, and/or other impurities.

The length of the filtered filling probe is approximately in a range between 5 and 11 inches, and preferably between 7 and 9 inches. The diameter of the filtered filling probe is approximately 1 inch.

As shown in FIG. 3, a coarse pre-filter 34 in the shape of a circular disc with a central coarse mesh 35 is provided resting on an internal shoulder 3 in press fit manner at the top of the filtered filling probe 10 at the lip 4. Preferably, this pre-filter can be formed of a one-piece plastic mesh and has substantially large openings or pore size suitable for allowing free water flow therethrough while blocking stones or the like which may be present in the water. Preferably, the pre-filter may have a pore size in a range from 50 to 200 microns.

Referring to FIGS. 4 and 5, the use of the universal hose coupling assembly 11 in conjunction with the separate drain probe 14 will now be described. The description of the universal hose coupling assembly 11 will be omitted since it is the same as was described with respect to FIG. 1. The drain probe 14 mates with the coupling assembly 11 at the sealing lip 36. The drain probe 14 preferably has a diameter the same or nearly the same as the filtered filling probe and is also received in the filling and draining valve 15 of the waterbed. It has a central main body 37 which is preferably solid and a lower leading tip portion 44 formed of four inwardly extending ribs 38*a*, 38*b*, 38*c*, 38*d* which terminate at a lower support ring 39 with a central aperture 41, most clearly shown in FIG. 6. Between the ribs 38*a*, 38*b*, 38*c*, 38*d*, drain slots 40*a*, 40*b*, 40*c*, 40*d* are provided. The material of the drain probe 14 is also preferably of a plastic similar to the filtered filling probe.

As shown in FIG. 5, the lip 36 at its upper surface mates with the double sealing ring 28 on the sealing lip 25 of the hose connector 12. At the leading end of the drain probe, a bevel 42 is provided which mates with the bevelled or tapered insert portion 26 of the hose connector 12 of the coupling assembly 11. Also, a male snap ring 43 is provided which mates with the female concave snap ring 27 on the tapered portion 26.

The drain probe 14 preferably has a length between 4 and 6 inches, and the conical end portion 44 preferably has a length between 1 and 2 inches.

As shown in FIG. 5, when it is inserted into the bed, the conical leading end portion 44 at ring 39 contacts an inner liner or floating baffle 20 so as to permit free entrance of the water 21 into the drain slots 40*a, b, c, d*.

Figure 7A:
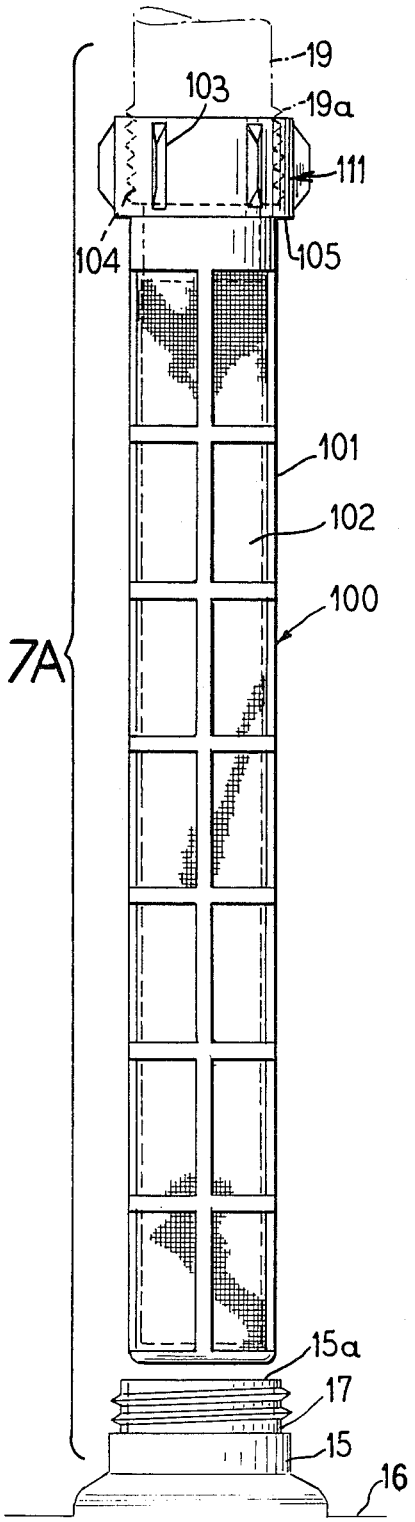
FIG. 7A is a side view showing a filtered filling probe of the invention with a one-piece integral hose coupling member at one end thereof.

In an alternate embodiment of the invention as shown in FIG. 7A, a one-piece filtered filling probe 100 is provided which is receivable in the male coupling 17 on the filling and draining valve 15 connected to the waterbed outer wall 16. The probe includes a cylindrical finger-like portion 101 having a cylindrical filter 102 which is the same as that previously described with respect to FIG. 1. The female hose coupling member 111 has outer knurls 103 and an inner thread 104. The hose coupling member 111 mates with a hose 19 having threads 19*a*.

The probe 100 is received within the coupling 17 on the waterbed in press fit fashion so as to seal therewith when fully inserted, and such that the leading end of the draining valve 15 and 15*a* abuts against the surface 105 of the hose coupling member 111.

Figure 7B:
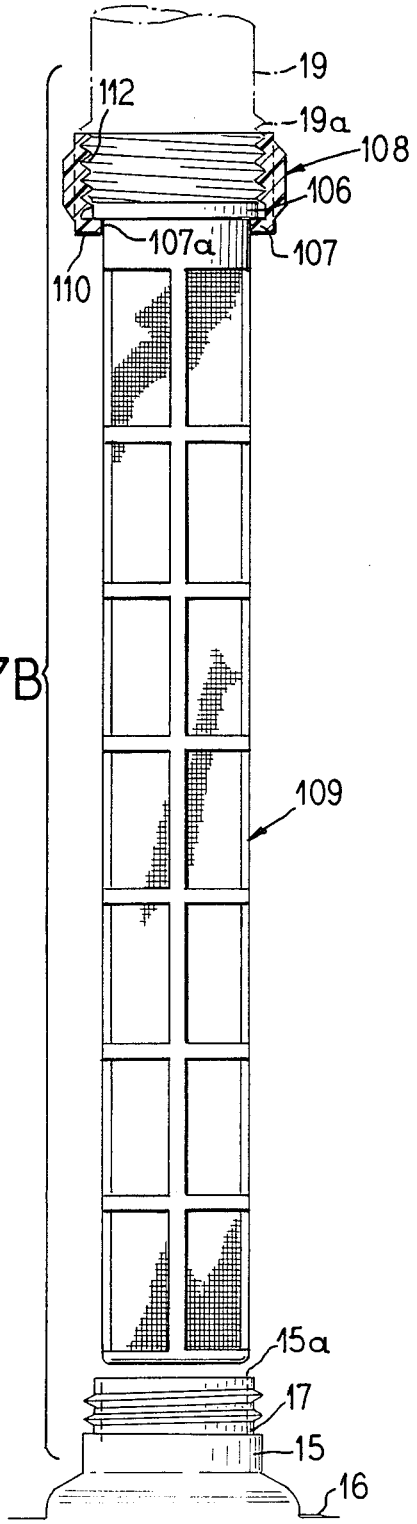
FIG. 7B is an alternate embodiment of FIG. 7A wherein the hose coupling member is freely receivable at one end of the filtered filling probe and retained there.

In the alternate embodiment shown in FIG. 7B, a separate filling probe 109 has a separate female hose coupling member 108 received at one end thereof where it is retained by a retaining collar 106 shown abutting against the end wall 107 of the hose coupling member 108. An aperture 107*a* is formed within the end wall 107. As in the case of FIG. 7A, the hose coupling member 108 has inner threads 112 which mate with the threads 19*a* of the hose 19. As in the case of FIG. 7A, the probe 109 is press fit into the valve coupling 15 on the waterbed in sealing fashion. However, the surface 110 abuts against the upper end 15*a* of the coupling 15.

FIG. 8 is an alternate embodiment of a filtered filling probe wherein a filter portion 113 of the probe extends horizontally beneath the waterbed outer wall 16. The probe has a lip 115 which rests on the valve 15, and is joined through a straight portion 116 and a slant portion 114 to the horizontal filter portion 113.

Although various minor changes and modifications might be proposed by those skilled in the art, it will be understood that I wish to include within the claims of the patent warranted hereon all such changes and modifications as reasonably come within my contribution to the art.

I claim:

1. A filtered waterbed filling system for filling a waterbed through a filling valve thereof, comprising:

a filtered filling probe having hose coupling means associated therewith for coupling to a hose, the filling probe having a width dimensioned to permit insertion of the probe into the valve of the waterbed, and the filtered filling probe having a surface formed of a filter means for preventing passage of at least some bacteria or other matter to aid in prevention of bacteria or algae growth in the water within the waterbed; and the filtered filling probe being cylindrical and having outer peripheral walls formed of said filter means.

2. A system according to claim 1 wherein said filter means aids in preventing passage of sulphur bascilus bacteria into the waterbed.

3. A system according to claim 1 wherein the filter means aids in preventing passage of particles and bacteria 1 micron or less in size.

4. A system according to claim 1 wherein the hose coupling means is integral and of one piece construction with the filling probe.

5. A system according to claim 1 wherein the hose coupling means comprises a separate female hose coupling member received over one end of the probe and retained by a retaining collar at said one end.

6. A system according to claim 1 wherein the filter means prevents passage of at least some impurities to aid in reducing deterioration of a mattress or inserts of the waterbed.

7. A filtered waterbed filling system for filling a waterbed through a filling valve thereof, comprising:

a filtered filling probe having hose coupling means associated therewith for coupling to a hose, the filling probe having a width dimensioned to permit insertion of the probe into the valve of the waterbed, and the filtered filling probe having a surface formed of a filter means for preventing passage of at least some bacteria or other matter to aid in the prevention of bacteria or algae growth in the water within the waterbed; and a portion of the probe with the filter means having a substantially horizontal longitudinal extent relative to a portion of the probe received in the valve of the waterbed which has a substantially vertical extent so that the portion of the probe with the filter means is substantially horizontal beneath a substantially horizontal outer wall of the waterbed.

8. A filtered waterbed filling system for filling a waterbed through a filling valve thereof, comprising:

a one-piece substantially cylindrical filtered filling probe having an integral female hose coupling at one end thereof and dimensioned to be insertable into the valve of the waterbed, the filtered filling probe having an outer peripheral surface at which a filter means is located for preventing passage of at least some bacteria or other matter to aid in the prevention of bacteria or algae growth in the water within the waterbed, and said filling probe having means for exposing a peripheral surface of the filter means at said outer peripheral surface of the filling probe substantially along an entire longitudinal axis of a portion of the probe which lies within the waterbed when the probe is inserted in the filling valve for permitting water to flow directly into the waterbed from the peripheral surface of the filling probe substantially along said entire longitudinal axis of the probe portion.

9. A filtered waterbed filling and draining system for filling and draining a waterbed through a male coupling on the waterbed, comprising:

hose coupling means having at a first end means for coupling to a hose and at an opposite end means for coupling to the male coupling on the waterbed to be filled or drained of water;

a separate filtered filling probe dimensioned to be insertable into the male couplng of the waterbed, means for sealably mating the hose coupling assembly to the filling probe, and the filtered filling probe having a filter means for preventing passage of at least some bacteria or other matter to aid in the prevention of bacteria or algae growth in the water within the waterbed; and a separate drain probe also dimensioned to be receivable within the waterbed male coupling, means for sealably mating said hose coupling assembly to the drain probe, and said drain probe having drain aperture means for draining water out of the waterbed.

10. A system according to claim 9 wherein the filter means aids in preventing passage of particles and bateria of 1 micron and less.

11. A system according to claim 9 wherein said filter means aids in preventing passage of sulphur bascilus bacteria.

12. A system according to claim 9 whererin said filtered filling probe forms a molded plastic cylinder together with a fabric-like filter material and wherein a matrix of vertical and horizontal circular ribs is provided with the filter material being formed as a cylinder and embedded in the ribs.

13. A system according to claim 9 wherein a length of the filtered filling probe is between 6 and 10 inches.

14. A system according to claim 9 wherein the drain probe has a leading tapered conical section with vertical ribs and drainage slots between the ribs.

15. A system according to claim 9 wherein the filtered filling probe has a length between 7 and 9 inches and the drain probe has a length between 4 and 6 inches.

16. A system according to claim 9 wherein the hose coupling means has a female hose connection portion, an intermediate narrower diameter throat, a sealing lip, a tapered insert portion below the sealing lip, and a female coupling element with threads and a flexible conical retaining collar slidably received and retained at said throat by said flexible conical retaining collar.

17. A system according to claim 16 wherein the flexible retaining collar has slots therein.

18. A system according to claim 9 wherein a pre-filter having a substantially coarser pore size than a pore size of the filter means is provided, said pre-filter being located at an end of the filtered filling probe where the probe is sealed to the hose coupling means.

19. A system according to claim 9 wherein the coupling means has a sealing lip, and a projecting sealing ring is provided on the sealing lip of the coupling means.

20. A system according to claim 9 wherein the coupling means has a tapered insert portion matable with a bevelled portion at a leading end of the filtered filling probe and also with a bevelled portion at a leading end of the drain probe when the drain probe is in place in lieu of the filling probe.

21. A system according to claim 20 wherein the tapered insert portion and also the bevelled portions of the filtered filling probe and the drain probe have snap ring means for a snap fit between the tapered insert portion and bevelled portions.

22. A system according to claim 20 wherein the tapered insert portion and also the bevelled portions of the filtered filling probe and the drain probe have means for retaining the tapered insert portion and the bevelled portions together.

23. A filtered waterbed filling and draining system, comprising:

hose coupling means having at a first end means for coupling to a male end of a hose and at an opposite end means for coupling to a male coupling on a valve on a waterbed to be filled or drained of water;

a separate filtered cylindrical filling probe dimensioned to be insertable into the waterbed valve and mateable and sealable with the hose coupling means, the filered filling probe having an outer cylindrical wall formed of a filter material having pore means for aiding in preventing passage of bacteria or other matter which causes bacteria or algae growth in the water within the waterbed; and a separate drain probe also dimensioned to be receivable within the waterbed valve and also being mateable and sealable with said hose coupling means, said drain probe having drain aperture means for draining water from the waterbed.

24. A filtered waterbed filling and draining system, comprising:

hose coupling means having at a first end means for coupling to a hose and at an opposite end having means for coupling to a male filling and draining valve on a waterbed to be filled or drained of water;

a separate cylindrical filtered filling probe having a diameter dimensioned to be insertable into the valve of the waterbed and mateable with the hose coupling means, the filtered filling probe having a cylindrical outer wall formed of a filter material having pore means to aid in preventing passage of bacteria or other matter which causes bacteria or algae growth in the water within the waterbed; and a cylindrical drain probe having a same diameter as said filling probe and which is also receivable in said waterbed valve and mateable with said hose coupling means, said drain probe having drain aperture means for draining water from the waterbed.

25. A system for filling a waterbed through a filling valve on the waterbed, comprising:

coupling means for coupling a source of water to a filling means inserted in the waterbed filling valve for filling the waterbed; and said filling means comprising an elongated substantially cylindrical probe having filter means extending along a longitudinal axis of a portion of the probe for filtering the water as it flows into the bed and preventing passage of at least some bacteria or other matter to aid in the prevention of bacteria or algae growth in the water within the waterbed, said probe portion having a width dimension selected to permit insertion thereof into the filling valve of the waterbed, and said probe portion having means for exposing a peripheral surface of said filter means at a peripheral surface of the probe portion substantially along an entire portion of the longitudinal axis of the probe portion which lies within the waterbed when the probe is inserted in the filling valve for permitting water to flow directly into the waterbed from the peripheral surface of the filter means substantially along said entire portion of the longitudinal axis.

26. A system according to claim 25 wherein the filter means comprises a filter material positioned at a peripheral surface of the probe.

27. A system for filling a waterbed through a filling valve on the waterbed, comprising:

an elongated finger-like probe having a central longitudinal axis, and a width dimension perpendicular to the longitudinal axis selected sufficiently small to permit insertion of the probe into the filling valve such that a substantial portion of the probe lies within the waterbed below the filling valve;

means for coupling a source of water to the probe;

the probe having a filter means for preventing passage of at least some bacteria or other matter to aid in the prevention of impurities in the water within the waterbed; and said probe having flow apertures therein, and said filter means comprising a filter material lying within said substantial portion of the probe below the filling valve and positioned in a flow path of the water as it flows through the probe and out the flow apertures.

28. A system according to claim 27 wherein said filter material has a longitudinal extent along the longitudinal axis of the probe.

29. A system according to claim 28 wherein said filter material extends substantially from a bottom end of the probe substantially up to a region of the filling valve when the probe is inserted in the filling valve.

30. A system for filling a waterbed through a filling valve on the waterbed, comprising:

coupling means for coupling a source of water to a filling means inserted in the waterbed filling valve for filling the waterbed; and said filling means comprising an elongated substantially cylindrical probe having filter means extending along a longitudinal axis of a portion of the probe for filtering the water as it flows into the bed and preventing passage of at least some impurities to aid in reducing deterioration of the waterbed caused by said impurities, said probe portion having a width dimension selected to permit insertion thereof into the filling valve of the waterbed, and said probe portion having means for exposing a peripheral surface of said filter means at a peripheral surface of the probe portion substantially along an entire portion of the longitudinal axis of the probe portion which lies within the waterbed when the probe is inserted in the filling valve for permitting water to flow directly into the waterbed from the peripheral surface of the filter means along said entire portion of the longitudinal axis.

* * * * *